US010274141B2

(12) United States Patent
Fan

(10) Patent No.: US 10,274,141 B2
(45) Date of Patent: Apr. 30, 2019

(54) STEMLESS LED LIGHT BULB AND FABRICATION METHOD THEREOF

(71) Applicant: Double Good Co., Hsinchu County (TW)

(72) Inventor: Szu-Min Fan, Hsinchu County (TW)

(73) Assignee: DOUBLE GOOD CO., Hsinchu County (TW)

( * ) Notice: Subject to any disclaimer, the term of this patent is extended or adjusted under 35 U.S.C. 154(b) by 79 days.

(21) Appl. No.: 15/257,104

(22) Filed: Sep. 6, 2016

(65) Prior Publication Data

US 2018/0066812 A1 Mar. 8, 2018

(51) Int. Cl.

| | |
|---|---|
| ***F21K 9/90*** | (2016.01) |
| ***F21K 9/235*** | (2016.01) |
| ***F21V 23/00*** | (2015.01) |
| ***F21K 9/237*** | (2016.01) |
| ***F21V 3/06*** | (2018.01) |
| *F21K 9/232* | (2016.01) |
| *F21Y 115/10* | (2016.01) |

(52) U.S. Cl.

CPC ..... *F21K 9/90* (2013.01); *F21K 9/235* (2016.08); *F21K 9/237* (2016.08); *F21V 3/061* (2018.02); *F21V 23/002* (2013.01); *F21K 9/232* (2016.08); *F21Y 2115/10* (2016.08)

(58) Field of Classification Search

CPC . F21K 9/237; F21K 9/90; F21K 9/232; F21V 23/002; F21V 3/061

See application file for complete search history.

(56) References Cited

U.S. PATENT DOCUMENTS

| | | | | |
|---|---|---|---|---|
| 3,945,697 | A * | 3/1976 | Armstrong | F21K 5/02 445/28 |
| 6,262,534 | B1 * | 7/2001 | Johnson, Jr. | H01J 61/34 313/26 |
| 9,732,913 | B2 * | 8/2017 | Weekamp | G02B 6/0003 |
| 2005/0194879 | A1 * | 9/2005 | Matsumoto | H01K 1/18 313/271 |
| 2012/0256538 | A1 * | 10/2012 | Takeuchi | F21K 9/232 313/512 |
| 2013/0141892 | A1 * | 6/2013 | Okazaki | F21V 3/00 362/84 |
| 2016/0369952 | A1 * | 12/2016 | Weekamp | G02B 6/0003 |

* cited by examiner

*Primary Examiner* — Anh T Mai

*Assistant Examiner* — Michael Chiang

(74) *Attorney, Agent, or Firm* — Chun-Ming Shih

(57) ABSTRACT

An LED light bulb and a fabrication method thereof are provided. A plurality of power wires for supplying electricity to an LED filament are fixed to form a power wire supporting structure for supporting and fixing the LED filament in position, without using a stem of a conventional LED light bulb, thereby simplifying fabrication processes of the LED light bulb and reducing fabrication costs thereof. Moreover, the LED light bulb does not require an internal space for accommodating the stem, and thus its length can be effectively reduced to ideally become a small-size light bulb.

4 Claims, 9 Drawing Sheets

STEMLESS LED LIGHT BULB AND FABRICATION METHOD THEREOF

BACKGROUND OF THE INVENTION

Field of the Invention

The invention relates to lighting fields, and more particularly, to an LED light bulb and a fabrication method thereof.

Descriptions of the Related Art

It is known that light-emitting diode (LED) light bulbs have many advantages such as lasting longer, more energy-efficient, more environmental friendly and reacting more rapidly, which make LED lighting gradually replace traditional lighting.

A fabrication method of a conventional LED light bulb is shown in FIG. 1. First in step S21, a stem 21, an LED filament 22 and two power wires 23 shown in FIG. 2-1 are provided. The stem 21 is used to support the LED filament 22. The stem 21 includes an exhaust tube 211 and a horn-shaped tube 212, wherein the exhaust tube 211 and the two power wires 23 pass through the horn-shaped tube 22. Then in step S22, as shown in FIG. 2-2, two ends of the LED filament 22 are soldered to the two power wires 23 passing through the stem 21 to form a semi-finished LED light bulb 24. Then in step S23, as shown in FIG. 2-3, a glass envelope 25 is provided to cover and protect a head part of the semi-finished LED light bulb 24. Then in step S24, as shown in FIG. 2-4, a sealer is used to seal the glass envelope 25, and an exhausting machine is used to discharge redundant gas from the glass envelope 25 through the exhaust tube 211. Then in step S25, any unnecessary portion of the exhaust tube 211 is removed, and a screw base 26 is provided, making the two power wires 23 electrically connected to the screw base 26 respectively, thereby forming a finished LED light bulb 2 shown in FIG. 2-5.

Therefore in the conventional LED light bulb 2, the stem 21 must be provided to support the LED filament 22, making the fabrication method of the LED light bulb 2 complicated and not cost-effective. As shown in FIG. 2-5, the LED light bulb 2 also requires an internal space 22 for accommodating a front end 213 of the stem 21, such that the LED light bulb 2 cannot be significantly reduced in length and cannot replace all the small-size traditional light bulbs.

SUMMARY OF THE INVENTION

In view of the shortages of prior technologies mentioned above, the invention provides an LED light bulb, including: a power wire support set, an LED filament, a glass envelope and a screw base. The power wire support set includes a first power wire, a second power wire and at least one fixed block. The fixed block fixes the first and second power wires to make them form a power wire supporting structure. An LED filament having two ends respectively soldered to a first end of the first power wire and a first end of the second power wire, making the LED filament supported by the power wire supporting structure; a glass envelope including a head part having a receiving space for receiving the LED filament, and a tail part tapered to clamp and fix second ends of the first and second power wires in position; and a screw base electrically connected to the second ends of the first and second power wires.

Optionally, the LED light bulb has a plurality of fixed blocks. The fixed block is made of glass. The first and second power wires are dumet wires. The screw base is soldered to the second ends of the first and second power wires.

Moreover, the invention further provides A fabrication method of an LED light bulb, including the steps of: providing an LED filament and a power wire support set, wherein the power wire support set includes a first power wire, a second power wire and at least one fixed block, and the fixed block fixes the first and second power wires to make them form a power wire supporting structure; soldering two ends of the LED filament to a first end of the first power wire and a first end of the second power wire respectively to form a semi-finished LED light bulb; providing a glass envelope, wherein the glass envelope has a receiving space in a head part thereof and a passage in a tail part thereof, allowing the LED filament to pass through the passage to be received in the receiving space; tapering the tail part of the glass envelope and sealing the passage to clamp second ends of the first and second power wires; and providing a screw base, and electrically connecting the second ends of the first and second power wires respectively to the screw base, to form a finished LED light bulb.

Optionally, the fabrication method further includes the step of: discharging redundant gas from the receiving space through the passage. Removing an unnecessary portion of the tail part of the glass envelope.

Compared to the conventional technology, the invention provides an LED light bulb and a fabrication method thereof, wherein two power wires for supplying electricity are used in place of the stem in the conventional LED light bulb. The power wires support and fix an LED filament in position. Besides eliminating the need of making the stem, the invention desirably simplifies fabrication processes of the LED light bulb and thereby reduces its fabrication costs. Moreover, the LED light bulb of the invention does not require an internal space for accommodating the stem, and thus its length may be significantly reduced, making the LED light bulb ideally used as a small-size light bulb.

BRIEF DESCRIPTION OF THE DRAWINGS

The above and other aspects, features and other advantages of the present invention will be more clearly understood from the following detailed description taken in conjunction with the accompanying drawings, in which:

FIGS. 2-1 to 2-5 are schematic diagrams showing an embodiment of the LED light bulb fabricated by the steps shown in FIG. 1.

FIG. 3 is a flowchart showing a fabrication method of an LED light bulb according to the invention.

FIGS. 4-1 to 4-5 are schematic diagrams showing an embodiment of the LED light bulb fabricated by the steps shown in FIG. 3.

DETAILED DESCRIPTION OF THE PREFERRED EMBODIMENT

Figure 1:
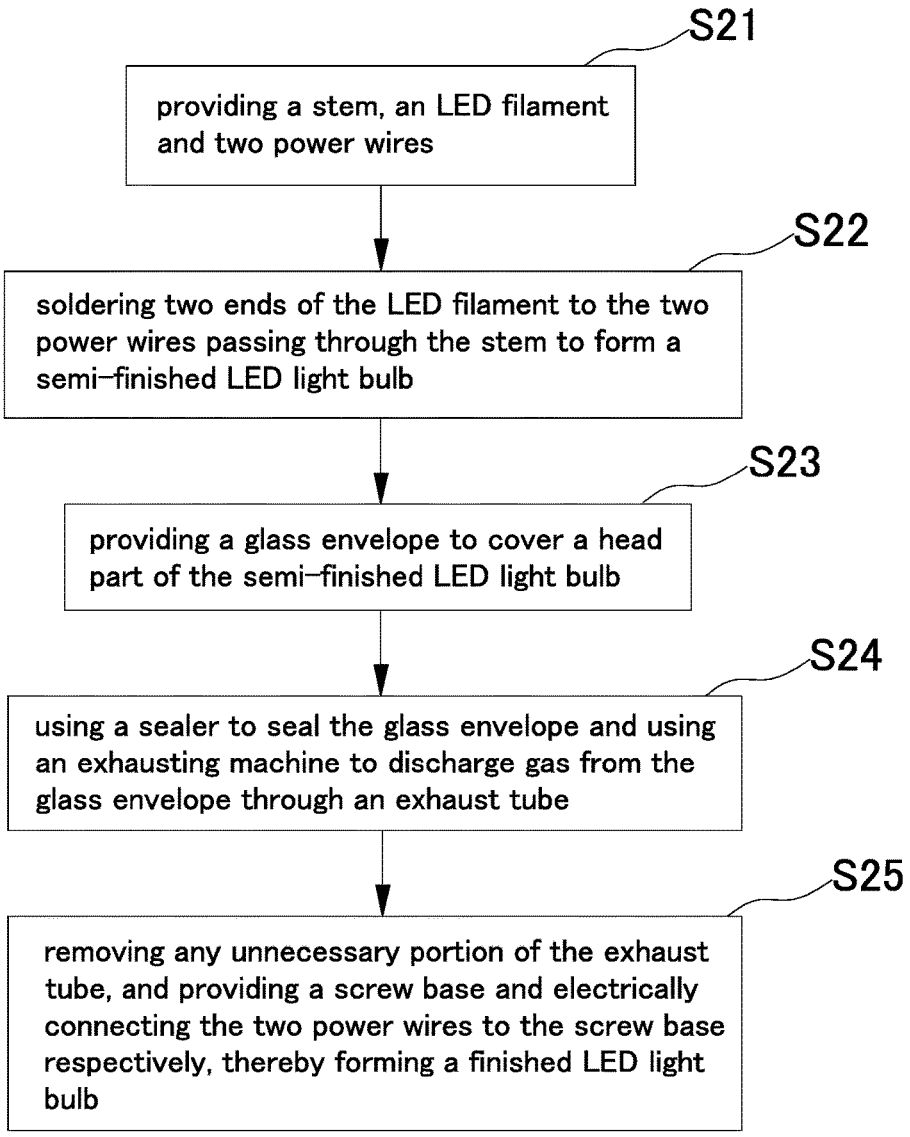
FIG . 1(Prior Art)
FIG. 1 is a flowchart showing a fabrication method of a conventional LED light bulb.

Embodiments of the present invention will now be described in detail with reference to the accompanying drawings. The invention may, however, be embodied in many different forms and should not be construed as being limited to the embodiments set forth herein. Rather, these embodiments are provided so that this disclosure will be thorough and complete, and will fully convey the scope of the invention to those skilled in the art. In the drawings, the shapes and dimensions of elements may be exaggerated for clarity, and the same reference numerals will be used throughout to designate the same or like components.

Figures 1, 2:
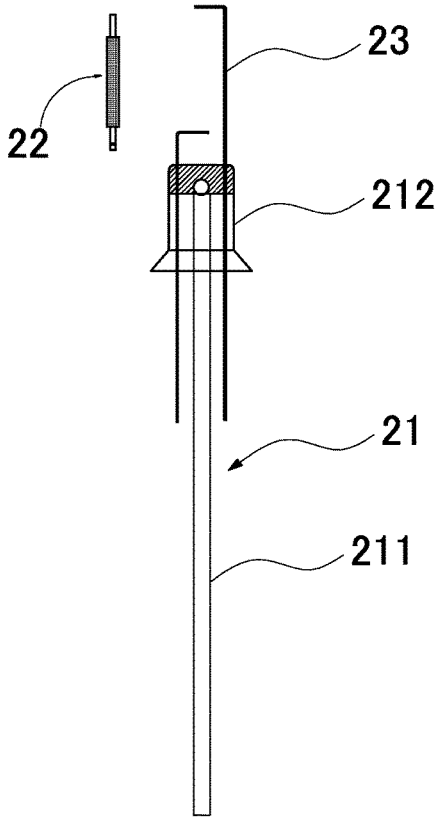
FIG.2-1(Prior Art)
Figure 2:
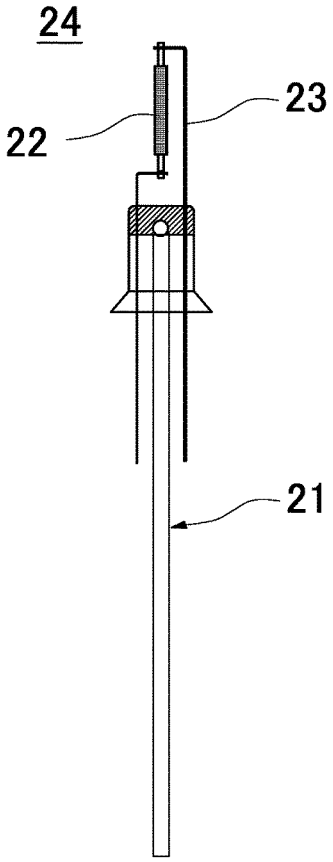
FIG.2-2(Prior Art)
Figures 2, 3:
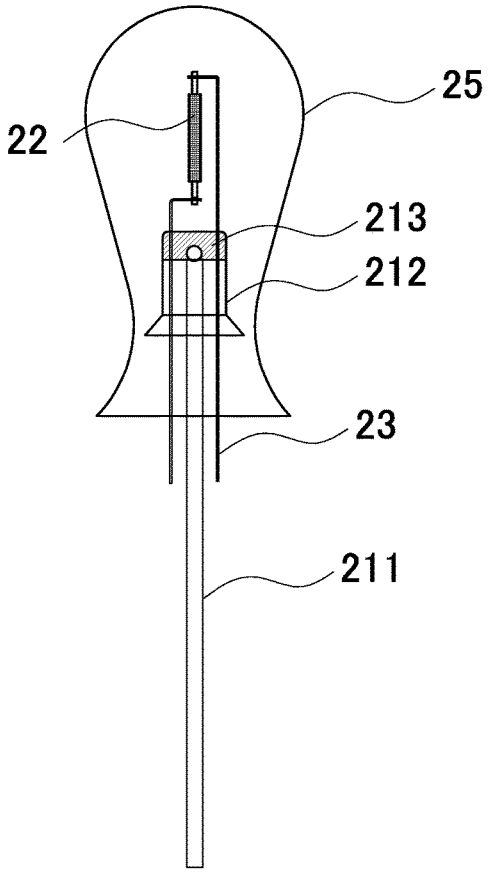
FIG.2-3(Prior Art)
Figures 2, 3, 4:
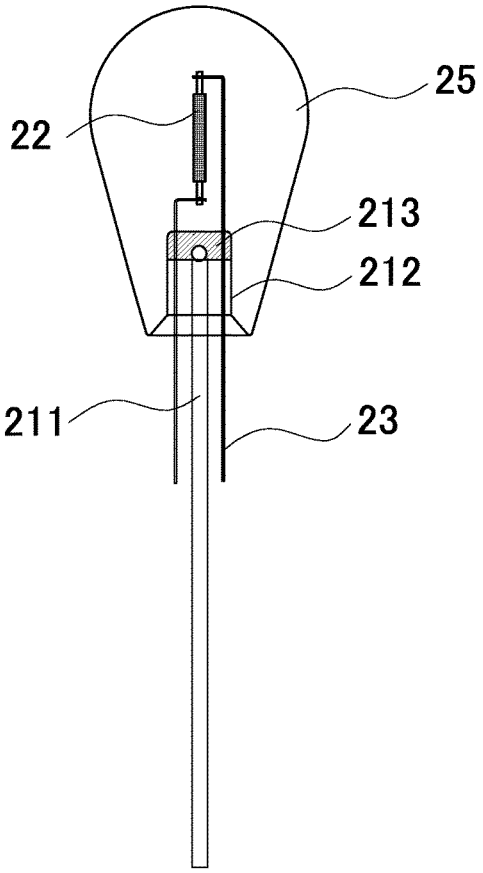
FIG.2-4(Prior Art)
Figures 2, 3, 4, 5:
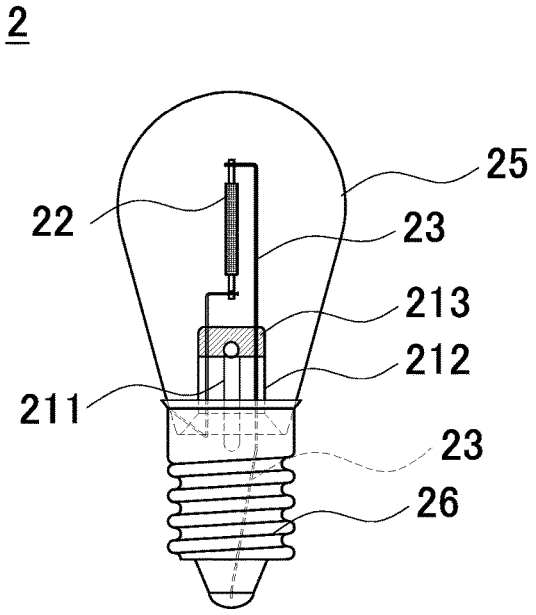
FIG.2-5(Prior Art)
Figure 3:
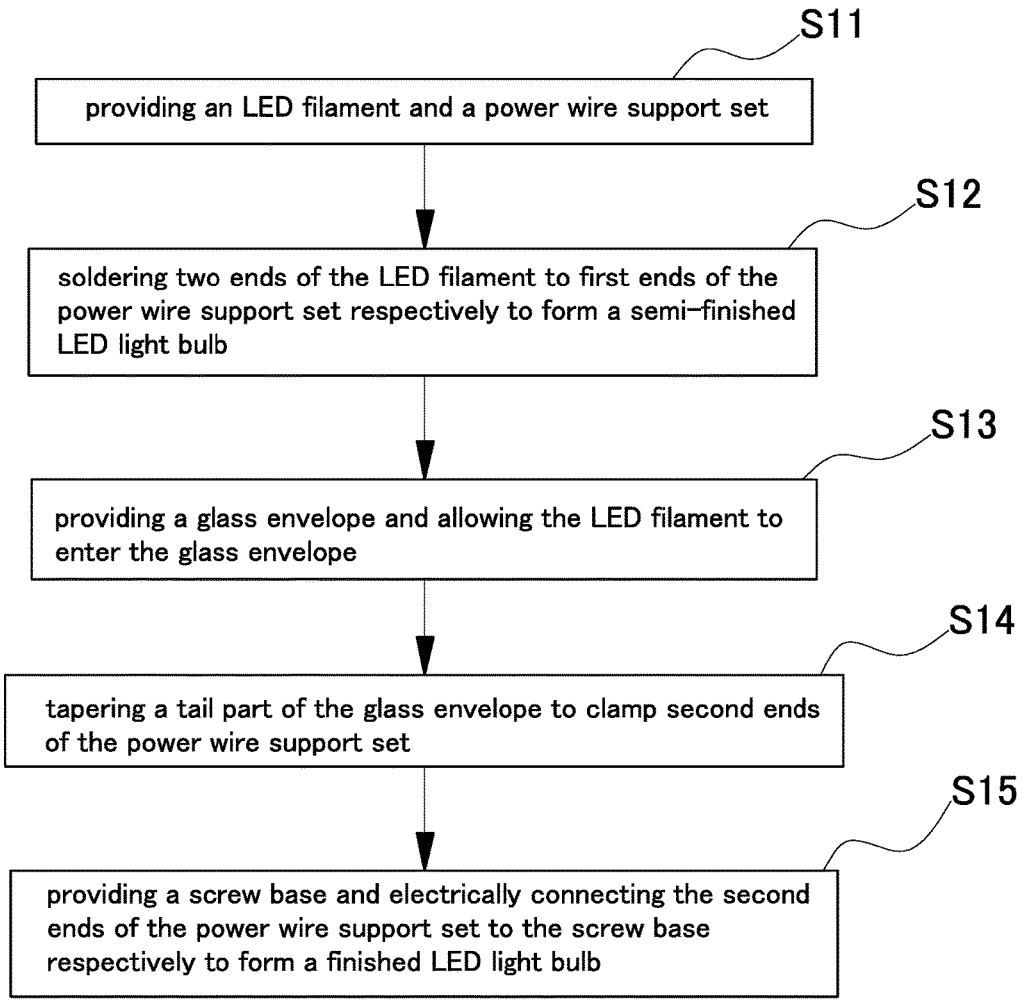
Figures 1, 4:
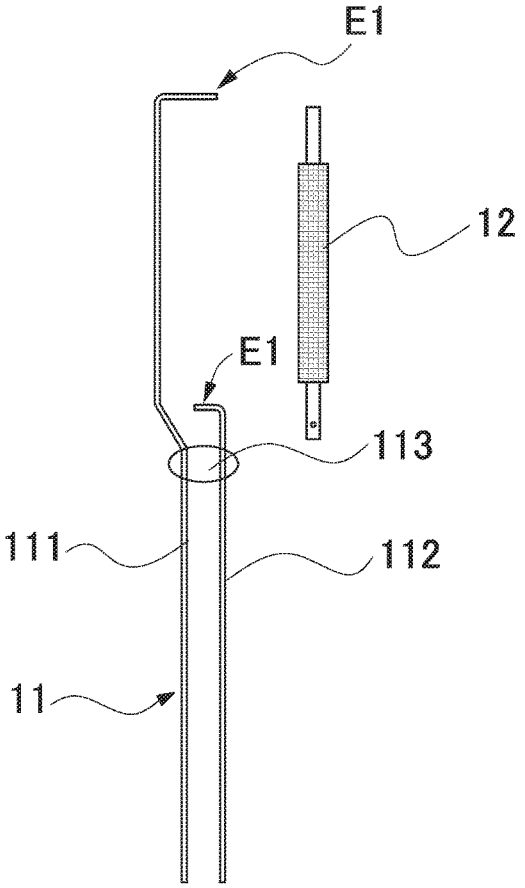
Figures 2, 4:
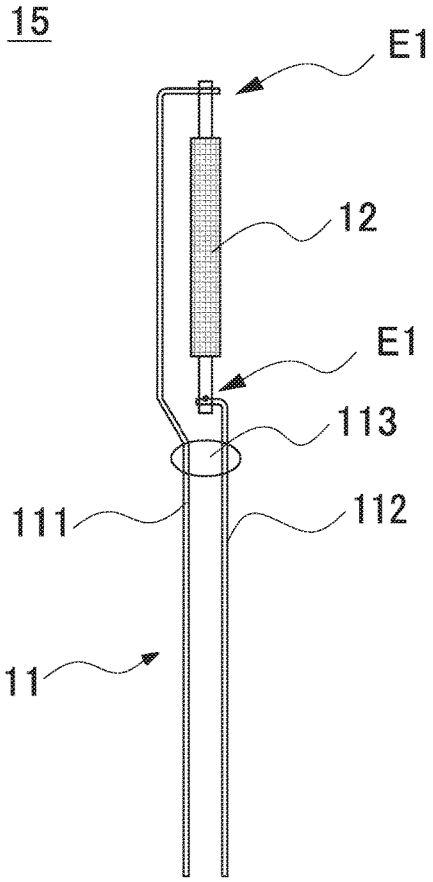
Figures 3, 4:
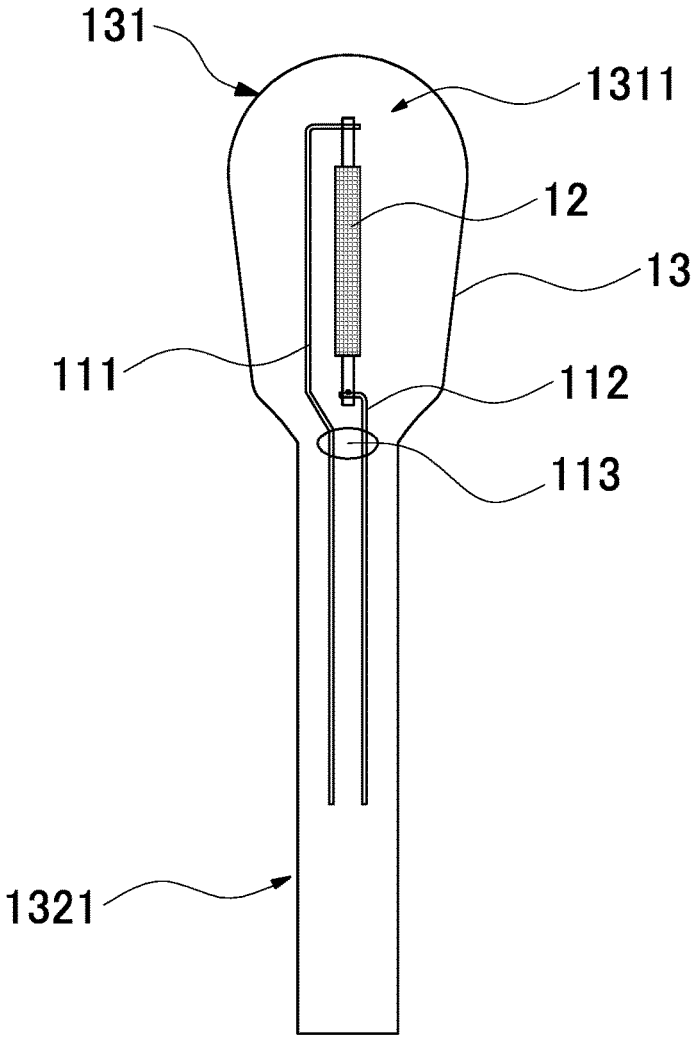
Figure 4:
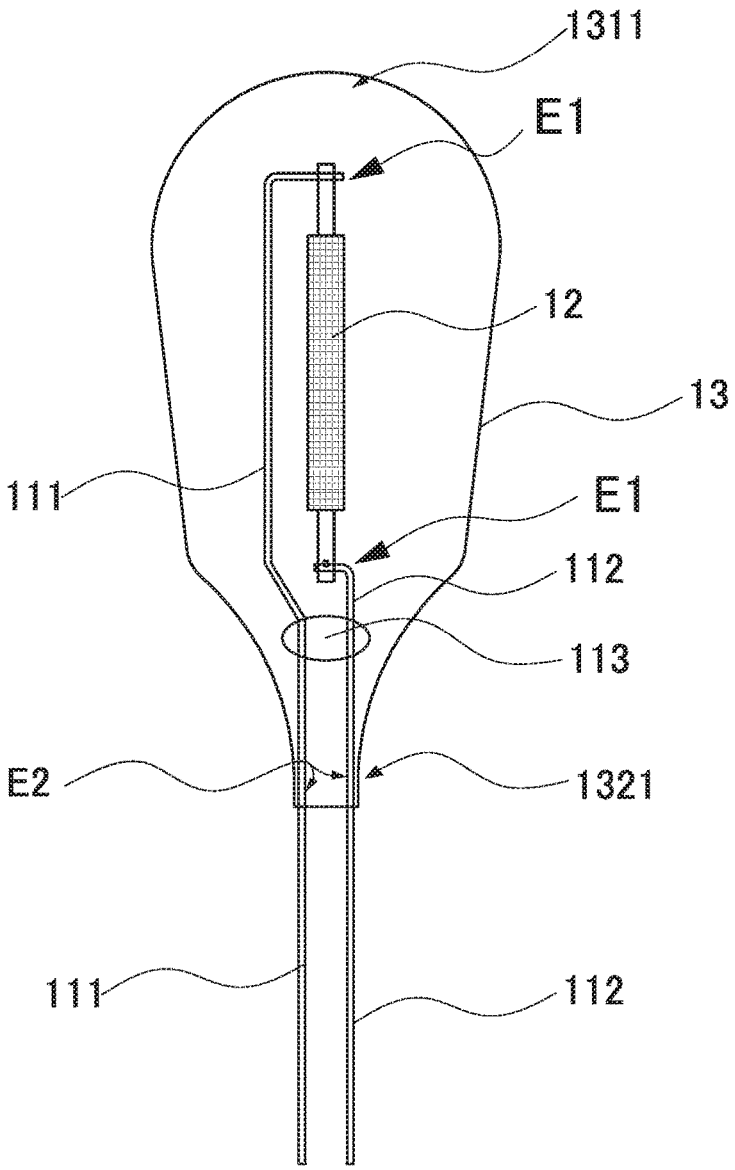
Figures 4, 5:
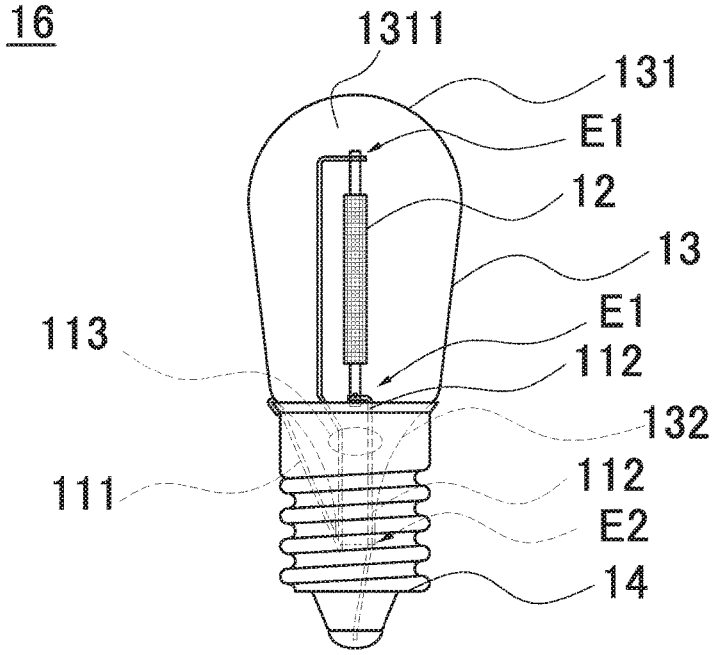

An embodiment of an LED light bulb according to the invention and a fabrication method thereof are disclosed with reference to FIGS. 3 to 4-5.

The fabrication method of the LED light bulb according to the invention includes the following steps shown in FIG. 3.

In step S11, as shown in FIG. 4-1, an LED filament 12 and a power wire support set 11 are provided. The power wire support set 11 includes a first power wire 111, a second power wire 112 and at least one fixed block 113. The first and second power wires 111, 112 are electrical conductors and can be dumet wires. There may be provided one or more fixed blocks 113, which can be made of glass. The fixed block 113 is used to fix the first and second power wires 111, 112 to integrally combine them to form a power wire supporting structure.

In step S12, as shown in FIG. 4-2, the LED filament 12 has two ends thereof respectively soldered to a first end E1 of the first power wire 111 and a first end E1 of the second wire 112, such that the LED filament 12 may obtain electricity through the first and second power wires 111, 112 and support from the power wire supporting structure to be properly fixed in position. This forms a semi-finished LED light bulb 15.

In step S13, as shown in FIG. 4-3, a glass envelope 13 is provided, wherein a head part 131 of the glass envelope 13 has a receiving space 1311, and a tail part 132 of the glass envelope 13 has a passage 1321 connected to the receiving space 1311. The LED filament 12 and the fixed block 113 may pass through the passage 1321 to be received in the receiving space 1311 and thus be protected by the glass envelope 13.

In step S14, as shown in FIG. 4-4, redundant gas in the receiving space 1311 is discharged through the passage 1321 so as to prevent moisture from staying in the operating environment of the LED filament 12. Then the tail part 132 of the glass envelope 13 is tapered and the passage 1321 is sealed in a manner to clamp second ends E2 of the first and second power wires 111, 112. Any unnecessary portion of the tail part 132 of the glass envelope 13 is removed.

In step S15, as shown in FIG. 4-5, a screw base 14 is provided. The second ends E2 of the first and second power wires 111, 112 are electrically connected to the screw base 14 respectively, thereby forming a finished LED light bulb 16.

FIG. 4-5 also shows the structure of the LED light bulb according to the invention. The LED light bulb 1 includes: a power wire support set 11, an LED filament 12, a glass envelope 13 and a screw base 14. The LED filament 12 has an operating voltage of from 8V to 240V. The power wire support set 11 includes a first power wire 111, a second power wire 112 and at least one fixed block 113. The first and second power wires 111, 112 provide a path of electricity to the LED filament 12. The screw base 14 is used to electrically connect an external power source. The first and second power wires 111, 112 may be made of dumet wires. The first and second power wires 111, 112 have first ends E1 thereof being soldered to two ends of the LED filament 12 respectively and have second ends E2 thereof being electrically connected to the screw base 14 respectively.

The fixed block 113 may be, for example, a glass ball, for fixing the first and second power wires 111, 112 to make them form a power wire supporting structure, which is used to provide support for the LED filament 12. The fixed block 113 can have a ball shape or any other shape that is easily made. A head part 131 of the glass envelope 13 has a receiving space 1311 where the LED filament 12 and the fixed block 113 are received. The receiving space 1311 may be filled with inert gas. A tail part 132 of the glass envelope 13 is tapered to clamp the second ends E2 of the first and second power wires 111, 112 so as to properly fix the first and second power wires 111, 112 in position and keep the receiving space 1311 intact.

Therefore, the invention provides an LED light bulb and a fabrication method thereof, wherein power wires for supplying electricity to an LED filament are used to support and fix the LED filament in position, such that a stem used in a conventional LED light bulb is not needed. This desirably simplifies fabrication processes of the LED light bulb and thereby reduces its fabrication costs. Moreover, the LED light bulb of the invention does not require an internal space for accommodating the stem, and thus its length may be significantly reduced, making the LED light bulb ideally used as a small-size light bulb.

The examples above are only illustrative to explain principles and effects of the invention, but not to limit the invention. It will be apparent to those skilled in the art that modifications and variations can be made without departing from the scope of the invention. Therefore, the protection range of the rights of the invention should be as defined by the appended claims.

What is claimed is:

1. An LED light bulb (1), including:

a power wire support set (11) including a first power wire (111), a second power wire (112) and at least one fixed block (113), wherein the fixed block (113) fixes the first and second power wires (111, 112) to form a power wire supporting structure;

an LED filament (12) having two ends respectively soldered to a first end (E1) of the first power wire (111) and a first end (E1) of the second power wire (112), making the LED filament (12) supported by the power wire supporting structure;

a glass envelope (13) including a head part (131) having a receiving space (1311) for receiving the LED filament (12) and the fixed block (113), and a tail part (132) tapered to clamp and fix only an outer side of each of the second ends (E2) of the first and second power wires (111, 112) in position; and a screw base (14) electrically connected to the second ends (E2) of the first and second power wires (111, 112), wherein the first power wire (111) includes a first portion and a second portion connected to the first portion to form an L-shaped structure, wherein the first portion is substantially perpendicular to and connected to the LED filament (12), and wherein the tail part (132) is directly inserted into the screw base (14), and each of the second ends (E2) of the first and second power wires (111, 112) is clamped by and further extends outside of the tail part (132) to be electrically connected to the screw base (14).

2. The LED light bulb (1) according to claim 1, wherein the fixed block (113) is made of glass.

3. The LED light bulb (1) according to claim 1, wherein the first and second power wires (111, 112) are dumet wires.

4. The LED light bulb (1) according to claim 1, wherein the screw base (14) is soldered to the second ends (E2) of the first and second power wires (111, 112).

* * * * *